United States Patent [19]

Dopson

[11] 4,133,746

[45] Jan. 9, 1979

[54] SYSTEM AND METHOD OF CONTROLLING FROTH FLOTATION

[75] Inventor: Gaylord W. Dopson, Oracle, Ariz.

[73] Assignee: Magma Copper Company, New York, N.Y.

[21] Appl. No.: 744,306

[22] Filed: Nov. 23, 1976

[51] Int. Cl.[2] ..... B03B 13/00; B03D 1/02

[52] U.S. Cl. ..... 209/1; 209/164

[58] Field of Search ..... 209/170, 164, 168, 1; 210/221 P, 101, 169, 170

[56] References Cited

U.S. PATENT DOCUMENTS

| | | | |
|---|---|---|---|
| 1,869,732 | 8/1932 | Asselstine | 209/170 |
| 2,073,148 | 3/1937 | Gayford | 209/164 |
| 2,088,624 | 8/1937 | Tschudy | 209/164 |
| 2,765,919 | 10/1956 | Juell | 210/221 P X |
| 2,994,432 | 8/1961 | Schluter | 210/101 |
| 3,255,882 | 6/1966 | Belasty | 209/1 |
| 3,471,010 | 10/1969 | Pick | 209/1 |
| 3,558,255 | 1/1971 | Rote | 210/101 |

FOREIGN PATENT DOCUMENTS

| | | | |
|---|---|---|---|
| 11699 | 12/1972 | Japan | 210/221 P X |
| 513723 | 7/1976 | U.S.S.R. | 209/1 |

*Primary Examiner*—Robert Halper
*Attorney, Agent, or Firm*—Pennie & Edmonds

[57] ABSTRACT

A method and system of maintaining substantially steady state conditions in a froth flotation operation. In the method an aqueous pulp of finely ground ore particles continuously flows into a flotation cell and is continuously aerated by admission of air wherein aqueous pulp of flotation concentrates substantially continuously overflow from the cell. The novel and improved method step comprises continuously monitoring the mass flow of flotation concentrates from the cell and, accordingly, varying the admission of aeration air into the pulp in the cell inversely with respect to the variations in the mass flow of the overflow to achieve steady state conditions in the cell. The system contemplated for continuously maintaining a substantially steady state condition in a froth flotation operation includes at least one froth flotation cell into which flows an aqueous pulp of finely ground ore particles, and aeration means fluidically communicating with the flotation cell for delivering air thereto. The improved system comprises aeration control means operatively connected to the cell for receiving overflows of pulp of flotation concentrates from the cell, and being operatively connected to the aeration means for controlling the aeration means by inversely varying the delivery of air to the froth flotation cell in response to variations in the mass flow rate of the overflow of pulp of flotation concentrates to attain steady state conditions.

4 Claims, 1 Drawing Figure

SYSTEM AND METHOD OF CONTROLLING FROTH FLOTATION

BACKGROUND OF THE INVENTION

1. Field of the Invention

This particular invention generally pertains to a system and method of substantially maintaining steady state conditions in a froth flotation operation. Specifically, the present invention is directed to a novel and improved method and system which continuously monitors the mass flow of the aqueous pulp of flotation concentrates which substantially continuously overflows from the flotation cell, whereby such monitoring results in the varying rate of admission of aeration air into the flotation cell, in a manner which is inversely proportional with respect to the variations in the mass flow of the concentrates to maintain steady state conditions which optimize the metallurgical output.

2. Description of the Prior Art

In the mining industry and, more particularly, in the field of froth flotation separation it is highly desirable to optimize the metallurgical output for such process. Difficulties, however, are experienced in attempting to provide and maintain such optimization since there are numerous variables which continually change during the normal and customary froth flotation process. As a result such process is in a state of disequilibrium wherein the continuity of flow of concentrates from each flotation cell is interrupted. Accordingly, an accurate control of such process is virtually extremely difficult to attain.

In actual field practice of the flotation process one of the more noteworthy causes for interruption of steady state operations are slight changes in ore characteristics, thereby requiring either more or less frother. Further, examples of additional factors affecting steady state conditions which have a tendency to diminish the metallurgical output of the flotation process are changes in water pressure, intermittent surging of flotation feed pulp, automatic or manual changes in grinding circuit, water additions to correct densities in the grinding mills, increased or decreased flow from pumps within the benefication system, changes in rougher concentrate density as a result of changes in flotation cell temperature, changes in blower pressure which serve to supply air to the flotation cells.

Heretofore, it has been a customary approach in this particular field to have a rougher flotation operator attempt corrective efforts in order to minimize the adverse effects of such process variations. In a conventional unit, for example, assuming flotation cells begin to "overfroth", the corresponding pulp levels would have to be lowered and/or air to such flotation cells reduced. On the other hand, if the benefication circuit has slowed down then the pulp levels would have to be correspondingly raised to achieve stabilization.

As is often the situation in practice, such stabilization period may be only for a very brief time interval since, as aforementioned, other process variables tend to upset the stabilization. Accordingly, the necessary stabilization adjustments would have to be continually repeated to achieve the desired steady state flow necessary for optimization of the froth flotation process.

A significant additional drawback, of course, to the above mentioned prior art shortcomings in attempting to control the process by correcting for variables to maintain equilibrium is the fact that valuable recoverable materials, such as copper and molybdenum are lost since they go to the final tailing. Such loss of minerals is, of course, economically undesirable.

As is believed rather evident from the foregoing description manual adjustments are rather limited. Moreover, for a manual operation to provide any meaningful effect to minimize the disruptive effects of the numerous variations occurring in the typical froth flotation process, such type of control would necessitate the employment of an excessive number of operators. This approach is, of course, commercially prohibitive in view of the rather significant time and labor costs involved, as well as the lack of complete continuity in providing for corrections to the variables, which tend to upset the desired or optimum operating conditions for the froth flotation operation. Additionally, the rather erratic and unpredictable occurrences of such disruptive factors in the process upset the stabilization of the entire ore benefication system.

In addition to the enumerated shortcomings generally associated with the manual approach in correcting the variances which tend to disrupt the desired operation of froth flotation process, there exist several other drawbacks. In the field, for instance, it has been determined that manual operators in attempting to achieve the desired stabilization often tend to overcompensate. Such overcompensation or adjustment by an operator will, of course, also tend to cause further disruptions or surges in the entire system thereby even further compounding the disruptions to steady state conditions resulting from the initial variance attempted to be controlled. Consequently, an efficient and reliable operation is virtually commercially impossible to successfully achieve with manual monitoring alone. As is evident such a control system significantly lacks the ability to maintain an accurate degree of high metallurgical recovery.

Several known methods have been proposed to alleviate the rather significant drawbacks generally associated with the manual control of froth flotation processes.

By way of specific example, one known approach for monitoring the froth flotation in a benefication process is described in U.S. Pat. No. 3,834,529 to Hart. This particular patent describes a somewhat complicated system for controlling the froth flotation, wherein the density of mineral slurry at selected stages in a flotation system is continuously monitored whereby the differentials in density of the slurry serve to provide control signals. In turn, the control signals permit adjustment of, for example, feed compositions. Beyond being rather complicated, the system does not provide for as quick and simple adjustment as could otherwise be desired.

Other known approaches to improve upon the efficiency of a flotation benefication process include, for instance, adjusting the pulp density in the lower portion of a flotation cell and by controlling the rate of tailing withdrawal through an outlet conduit. Another conventional unit employs a relatively small sampling vessel which continuously senses the quantity of froth overflow to control the liquid level within the froth flotation cell by appropriately raising and lowering a tailings gate in response to pressure differentials. Moreover, any effort to control the pulp level with a monitoring system is known industrial rougher flotation cells would be rather complicated and cumbersome to install, given the configuration of conventional rougher flotation circuits. For example, four level controls would have to be put on each bank of cells. Such arrangement, therefore, would involve twenty-four level controls in a standard industrial arrangement. Quite obviously, such an approach beyond being complicated and expensive would also be subject to an increased likelihood of maintenance and repair costs.

Still another conventional system particularly adapted for use in controlling froth flotation operations essentially employs an instantaneous radiation assaying unit for assaying one of the elemental content of a flotation pulp sample.

Although numerous kinds of systems and methods exist for optimizing the froth flotation system they are, in general, relatively complicated in structure and operation not to mention fail to generally provide for a system which simply, yet reliably provides for a continuous and automatic control of the froth flotation process which provides for improved metallurgical tonnage recovery.

SUMMARY OF THE INVENTION

Broadly, it is an object of the present invention to improve upon the above mentioned processes and systems used for controlling a froth flotation process. Towards this end, and in accordance with the general principles of the present invention, there is provided a simple and reliable method of continuously controlling and maintaining substantially steady state conditions in a froth flotation operation, wherein an aqueous pulp of finely ground ore flows continuously into a flotation cell and is continuously aerated by admission of air, and aqueous pulp of flotation concentrates substantially continuously overflow from the cell wherein the mass flow of flotation concentrates from the cell is continuously monitored so that the rate of admission of aeration air into the pulp in the cell is inversely varied with respect to the variations of the mass flow.

The system contemplated for continuously maintaining a substantially steady state condition in a froth flotation operation includes at least one froth flotation cell into which flows an aqueous pulp of finely ground ore particles, and aeration means fluidically communicating with the flotation cell for delivering air thereto. The improved system comprises aeration control means operatively connected to the cell for receiving overflows of pulp of flotation concentrates from the cell, and being operatively connected to the aeration means for controlling the aeration means by inversely varying the delivery of air to the froth flotation cell in response to variations in the mass flow rate of the overflow of pulp of flotation concentrates to attain steady state conditions.

BRIEF DESCRIPTION OF THE DRAWINGS

The above, as well as other objects, features, and advantages of the present invention will become readily apparent upon a reading of a detailed description of the present invention made in accordance with the principles thereof when viewed in conjunction with the accompanying drawing of FIG. 1 which represents in diagrammatic form a froth flotation system made in accordance with the principles of this invention.

DETAILED DESCRIPTION

Figure 1:
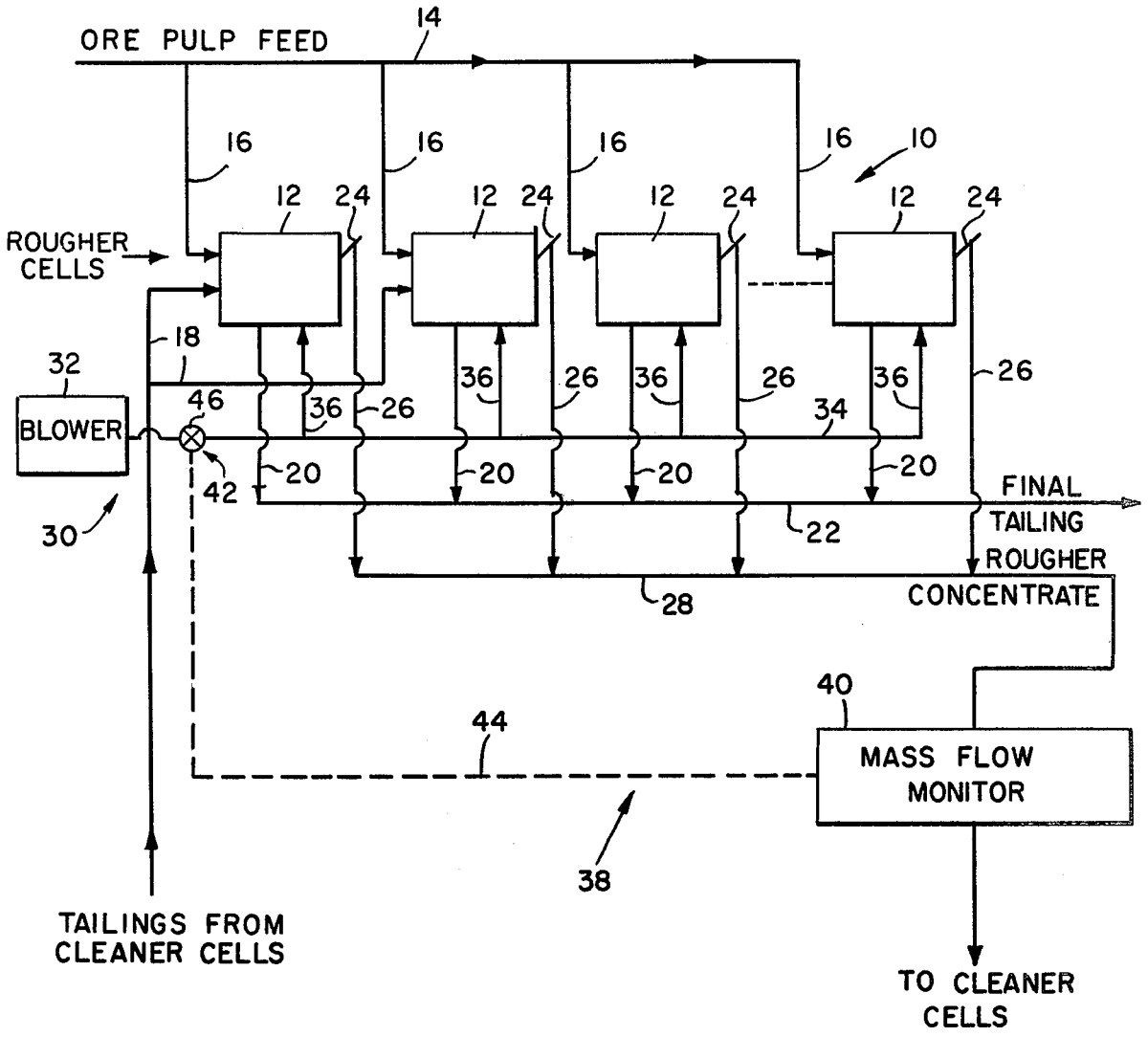

Referring to FIG. 1 of the drawing it will be understood that such represents, in diagrammatic form, a froth flotation system embodying the principles of this invention and being depicted generally by reference numeral 10. Such froth flotation system 10 is customarily utilized in a typical industrial ore benefication process which essentially functions to recover metallic particles from the ore.

In particular, the froth flotation system 10 may include a multiplicity of standard froth flotation rougher cells 12 of the type usually employed in the metallurgical benefication process. Since the rougher froth flotation cells 12 are standard and, further, since they do not in themselves form an aspect of this invention a detailed description of their structure, assembly and operation will be dispensed with. It should be mentioned, however, that in the conventional froth flotation process finely crushed minerals are floated and gather in and on the surface of bubbles or air driven into or generated in the liquid in some convenient manner. It will be appreciated that the ore separation occurs as a result of some of the finely crushed minerals sinking, whereas other minerals continue to float. In a rougher flotation cell of the category being generally described above, the bulk of the gangue or undesired minerals is removed from the ore.

As depicted in the drawing, each of the schematically represented rougher froth flotation cells 12 has ore pulp feed directed thereto from a conventional source (not shown) through common feed line 14 and thereafter, through independent branch lines 16. It will be observed that each feed branch line 16 communicates with the rougher flotation cells 12 to provide generally parallel streams of such ore pulp. Tailings delivery pipes 18 are conventionally connected in a suitable fashion to the froth flotation cells 12 to introduce thereinto tailings from the standard cleaner cells also not shown. The purpose for such delivery of the tailings is well known in the art. A plurality of final tailings outlet conduits 20 are conventionally connected to and extend from each rougher froth flotation cell 12. The final tailings outlet pipes 20 are fluidically connected within a common final tailing outlet duct 22. It will be understood that the tailings are transferred for subsequent industrial benefication operations not forming an aspect of this invention. Each of the rougher froth flotation cells 12 has appropriately connected thereto overflow outlet receiving means indicated generally by reference numeral 24 including overflow lines 26 which function to continuously receive from each rougher cell 12 the mass flow of the pulp of flotation concentrates. It should be pointed out that the aqueous pulp of flotation concentrates ordinarily flows over the flotation cell as a result of the flotation process. Fluidically connected to each of the overflow lines 26 is a common sump outlet conduit 28.

In the illustrated embodiment there is depicted a common kind of aeration blowing means 30 which is generally associated with the rougher flotation cells 12. Aeration means 30 serves to provide the necessary air under suitable pressure for purposes of cooperating with the ore pulp feed in the flotation cells 12 to separate the desired minerals by continuously aerating the finely ground ore particles which continuously flow into each flotation cell 12. Besides air other suitable kinds of gases are also envisioned within the spirit and scope of this invention. Aeration means 30 essentially comprises a blower unit 32, main delivery conduit or header 34 and feeder lines 36. The blower unit 30 may be any standard type which is constructed and assmebled in a known manner. Blower unit 32 serves, of course, to deliver low pressure air to the froth flotation cells 12. The main air header 34 leads from blower unit 32 and is fluidically interconnected with each of the rougher flotation cells 12 by corresponding feeder lines 36. Accordingly, by this arrangement the low pressure air travels directly to the rougher flotation cells 12 to combine with and aerate the ore pulp feed to control the benefication process.

The present invention includes the mass flow or aeration control means designated by reference numeral 38. Essentially hereinafter described, the aeration control means 38 includes mass flow monitoring means 40 and valve means 42. It will be noted that the common outlet conduit 28 fluidically interconnects each of the rougher concentrate overflow lines 26 with mass flow monitoring means 40. By virtue of this arrangement, it will be appreciated that the pulp of flotation or rougher concentrates flow from each flotation cell 12 to the mass flow monitoring means 40.

With specific reference to the mass flow monitoring means 40, such is adapted to measure the mass flow of the aqueous pulp of flotation concentrates and transmit a signal representative of current mass flow rate to valve means 42 for purposes presently made clear. Such mass flow monitoring means 40 may be comprised of a standard type of magnetic flow meter (not shown) appropriately interposed in the common outlet sump conduit 28 to measure the mass flow in mass per minute. A suitable density measuring device, also not shown, would be able to measure the percentage of solids in the rougher concentrate. Also, a conventional multiplier can be continuously operated to combine the flow rate and percentage of solids to give a continuous read out signal indicative of mass flow of the rougher concentrate, for instance in dry tons per hour. By a suitable electrical lead 44, such representative signal is transferred to the valve means 42. It should be realized, of course, that other kinds of mass flow monitoring devices may be realized in accordance with the principles of this invention without departing from the scope thereof.

With specific reference to the valve means 42, it may be comprised of any conventional and suitable solenoid single type valve 46. The valve 46 is adapted to enable adjustment in the flow rate of the low pressure air being delivered to each flotation cell 12 since it is located in main header line 34. It is at once apparent that a very simple arrangement is provided for adjusting the flow of air to each rougher flotation cell 12. According to this invention the valve 46 is to be adjusted in response to the representative signal from mass flow monitor 40 to proportionately vary the delivery of air to the rougher cells 12. More specifically the valve 46 is constructed to regulate the mass flow of air from blower unit 32 in an inverse manner with respect to the mass flow rate determined by mass flow monitor 40. Consequently, by adjusting the amount of air to each of the rougher flotation cells 12 a quick control of the flotation process is able to be effected to return the froth flotation process to steady state after any typical system variances, noted earlier, cause a disruption to the desired system equilibrium.

Owing to the above described unique organization of components there is provided an extremely simple and quick manner which offsets any variances that would otherwise upset the steady state conditions in the flotation process, particularly since the control of the rougher flotation cells is accomplished with a single valve which controls the low pressure air from a single header conduit from the blower unit. This approach is significantly simpler in concept and construction than any heretofore known prior art attempt to provide for quick corrective action such as by adjusting the pulp level in the flotation cells or by adjusting other variables.

The operation and method of the invention is believed to be self-evident. To supplement such description, however, it will be understood that in the froth flotation operation the aqueous pulp of finely ground ore is fed substantially continuously in streams to a plurality of flotation cells. The low pressure from the blower unit 32 is fed from a common header 34 into each flotation cell to aerate the pulp therein. In the usual manner a pulp of flotation concentrates overflow from each cell into and through a common concentrate conduit 28. To attain substantially steady state conditions in each flotation cell 12 the aeration control means 38 monitors the mass flow of rougher concentrates through the common concentrate conduit 28 by mass flow monitor 40. In response to the signals generated by the mass flow monitor 40 the valve 46 is regulated to vary the rate of air flow through the common header 34 to the flotation cells 12 in an inversely proportional manner with respect to the mass flow rate. As a consequence thereof, a simple, reliable and quick control of the flotation process is effected.

In actual field tests it has been determined, for instance, that through the application of this particular invention there can be an increase in the recovery of valuable metals, such as copper in the amount of 25 to 30%.

Based upon the foregoing description of this invention not only is there provided a control system and process which automatically and continuously offsets the disruptive effects of the numerous variables which upset steady state conditions in a froth flotation process, but does so in a simple, convenient, reliable, and economical manner, whereby the metallurgical recovery is substantially enhanced.

While the invention has been described in connection with the preferred embodiments, it is not intended to limit the invention to the particular forms set forth above but, on the contrary, it is intended to cover such alternatives, modifications, and equivalents as may be included within the spirit and scope of the invention as defined by the appended claims.

What is claimed is:

1. The method of maintaining substantially steady state conditions in a froth flotation operation, wherein an aqueous pulp of finely ground ore flows continuously into a flotation cell and is continuously aerated by admission of air, and an aqueous pulp of flotation concentrates substantially continuously overflows from said cell, which comprises continuously monitoring the mass flow of flotation concentrates from the cell and varying the rate of admission of aeration air into the pulp in the cell inversely with respect to variations in said mass flow.

2. The method of controlling the course of a froth flotation operation wherein a continuous flow of air is delivered into a pulp of finely ground ore in a flotation cell, and an aqueous pulp of flotation concentrates is continuously discharged from said cell, which comprises continuously measuring the volumetric rate of flow and the density of the concentrate pulp discharge, combining said measurements to determine continuously the mass flow of solids in the concentrate discharge, and varying the rate at which air is delivered into the ore pulp in the flotation cell inversely with respect to said mass flow.

3. In a system for maintaining substantially steady state conditions in a froth flotation operation including one froth flotation cell into which flows an aqueous pulp of finely ground ore particles and aeration means fluidically communicating with said flotation cell for delivering air to said cell, the improvement comprising aeration control means operatively connected to said cell for receiving overflows of the aqueous pulp of flotation concentrates from said cell and for monitoring mass flow rate of overflow flotation concentrates and being operatively connected to said aeration means for controlling said aeration means such that said aeration means inversely varies the delivery of air to said froth flotation cell in response to variations in the mass flow rate of overflow flotation concentrates.

4. The system of claim 3 in which said aeration means includes a single valve means which regulates the flow of air to said cell.

* * * * *